US006910490B1

(12) United States Patent
Villa

(10) Patent No.: US 6,910,490 B1
(45) Date of Patent: Jun. 28, 2005

(54) UMBRELLA APPARATUS

(76) Inventor: Francisco Villa, 9513 Ave. M, Chicago, IL (US) 60617

( * ) Notice: Subject to any disclaimer, the term of this patent is extended or adjusted under 35 U.S.C. 154(b) by 0 days.

(21) Appl. No.: 10/358,715

(22) Filed: Feb. 5, 2003

(51) Int. Cl.[7] ..... A45B 45/00
(52) U.S. Cl. ..... 135/20.1; 135/24.4
(58) Field of Search ..... 135/20.1, 20.3, 135/22, 25.4, 28

(56) References Cited

U.S. PATENT DOCUMENTS

| | | | | |
|---|---|---|---|---|
| 256,308 | A * | 4/1882 | Forster | 135/20.1 |
| 779,241 | A * | 1/1905 | Schuller | 135/20.1 |
| 990,632 | A * | 4/1911 | Burton | 135/20.1 |
| 1,589,299 | A * | 6/1926 | Metzger | 135/20.1 |
| 3,464,431 | A * | 9/1969 | Loeffler | 135/20.1 |
| 3,802,452 | A | 4/1974 | Weber | |
| 4,077,421 | A * | 3/1978 | Schultes et al. | 135/25.3 |
| 4,144,900 | A * | 3/1979 | Kinski | 135/20.1 |
| 4,274,429 | A * | 6/1981 | Kinski | 135/20.1 |
| 5,002,080 | A * | 3/1991 | Ma | 135/20.1 |
| D328,182 | S * | 7/1992 | Lo | D3/5 |
| 6,336,450 | B1 | 1/2002 | Collet | |

* cited by examiner

*Primary Examiner*—Ramon O Ramirez

(57) ABSTRACT

A umbrella apparatus for protecting the head of one more people from the rain. The umbrella apparatus includes a shank member being designed for being gripped by a user. A support assembly is operationally coupled to the shank member. The support assembly is selectively actuated between a deployed position and an expanded position whereby the support assembly is designed for being actuated by the user. A canopy member is coupled to the support assembly. The canopy member opens when the support assembly is the deployed position whereby the canopy member provides a first coverage area designed for sheltering the user from the rain. The canopy member expands when the support assembly is in the expanded positioned whereby the canopy member provides a second coverage area greater than the first coverage area designed for sheltering a plurality of people from the rain.

1 Claim, 5 Drawing Sheets

UMBRELLA APPARATUS

BACKGROUND OF THE INVENTION

1. Field of the Invention

The present invention relates to collapsible umbrellas and more particularly pertains to a new umbrella apparatus for protecting the head of one more people from the rain.

2. Description of the Prior Art

The use of collapsible umbrellas is known in the prior art. U.S. Pat. No. 6,336,450 describes a device for heating a terrace by deflecting heat off of an umbrella like structure. Another type of collapsible umbrella is U.S. Pat. No. 3,802,452 having an umbrella that is expanded to cover a greater area. U.S. Pat. No. 4,077,421 has an umbrella that can be shortened to reduce amount of coverage provided by the umbrella.

While these devices fulfill their respective, particular objectives and requirements, the need remains for a device that has certain improved features allowing for the expansion of the canopy to shelter multiple people.

SUMMARY OF THE INVENTION

The present invention meets the needs presented above by providing separating assemblies that separate from each other to expand the canopy member and provide a larger area of coverage.

Still yet another object of the present invention is to provide a new umbrella apparatus that allows a user the actuate the user to expand the canopy member and shelter multiple people.

To this end, the present invention generally comprises a shank member being designed for being gripped by a user. A support assembly is operationally coupled to the shank member. The support assembly is selectively actuated between a deployed position and an expanded position whereby the support assembly is designed for being actuated by the user. A canopy member is coupled to the support assembly. The canopy member opens when the support assembly is the deployed position whereby the canopy member provides a first coverage area designed for sheltering the user from the rain. The canopy member expands when the support assembly is in the expanded positioned whereby the canopy member provides a second coverage area greater than the first coverage area designed for sheltering a plurality of people from the rain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
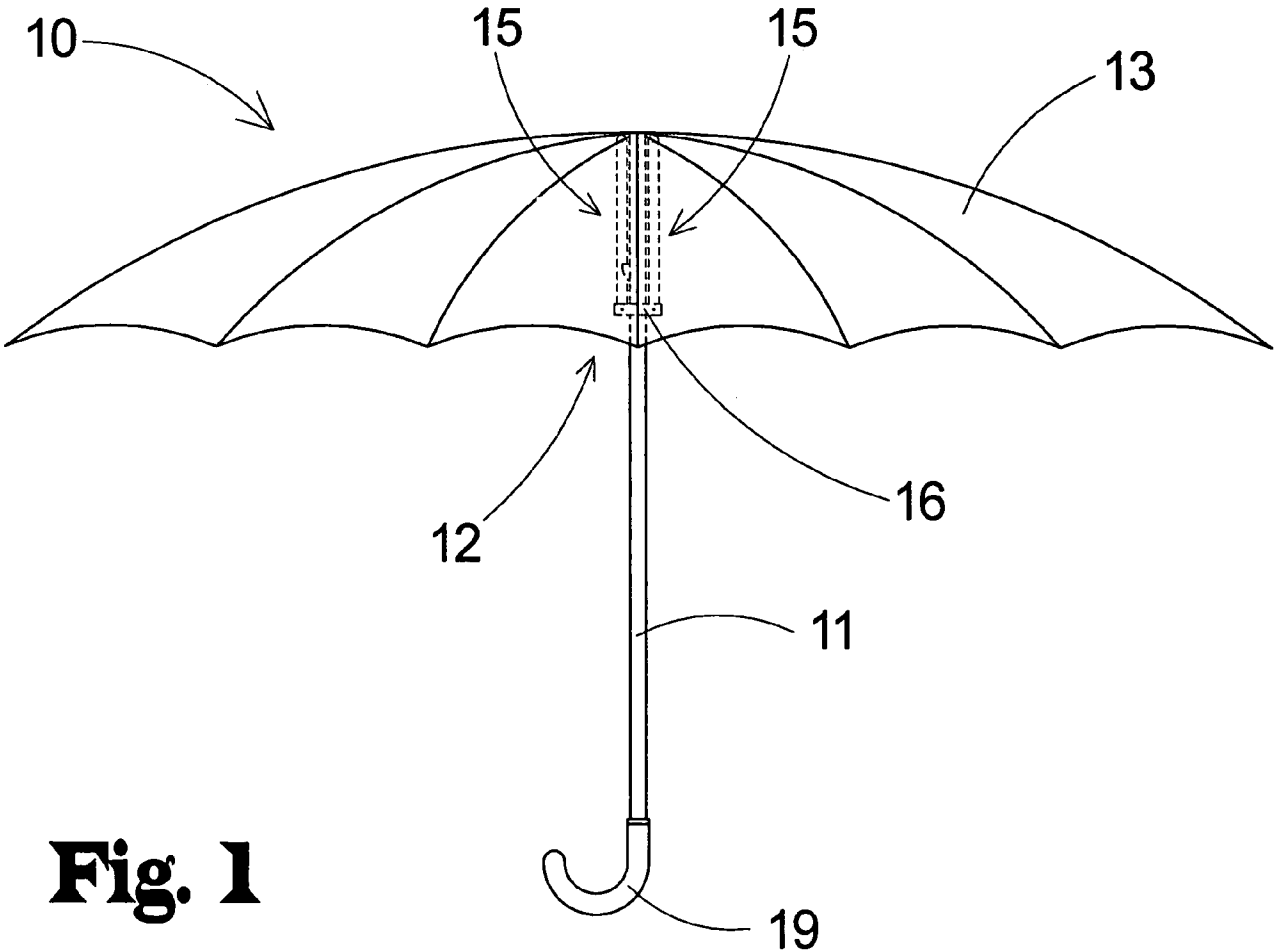
FIG. 1 is a front view of a new umbrella apparatus according to the present invention showing the support assembly in the deployed position.
Figure 2:
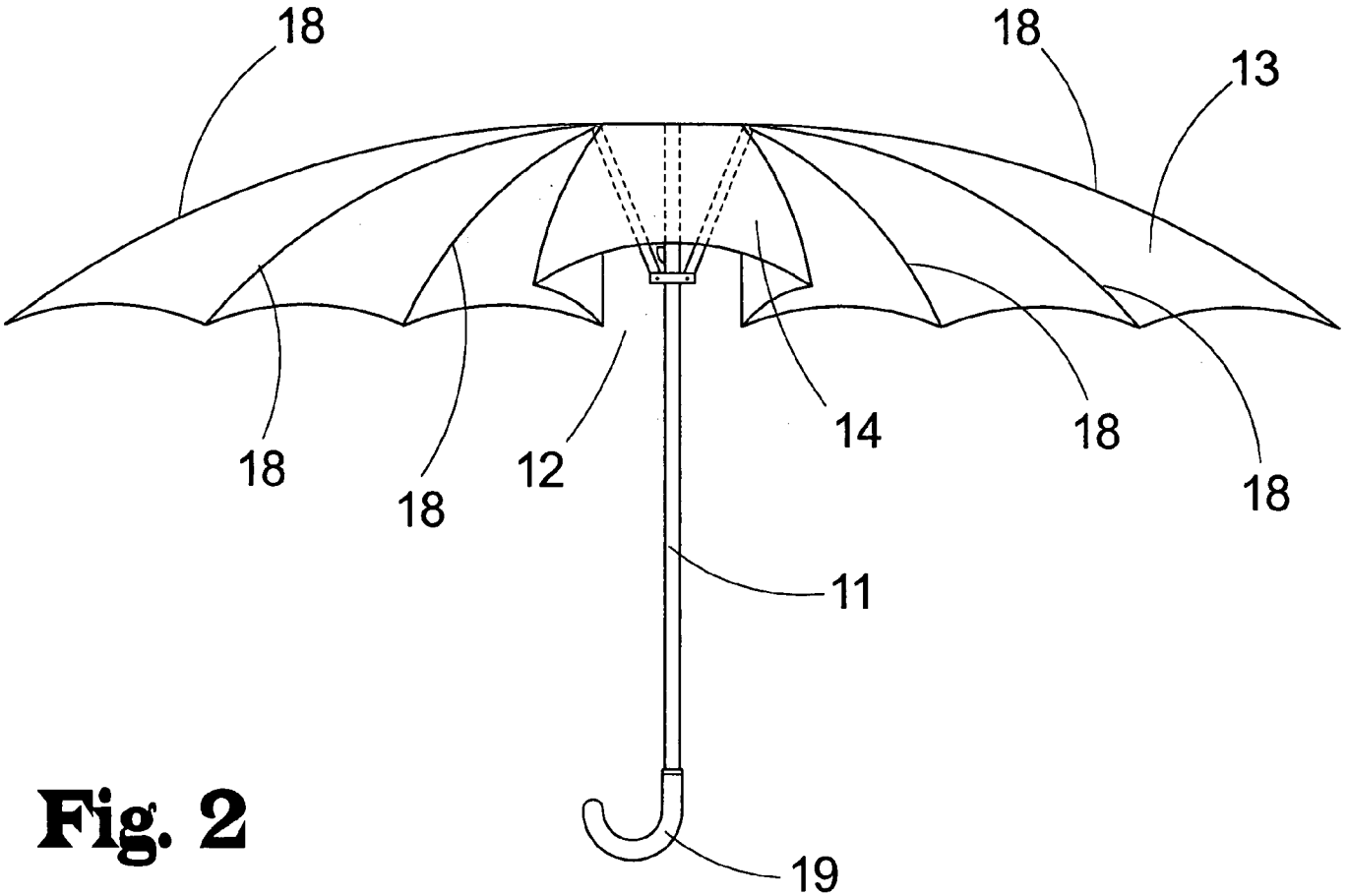
FIG. 2 is a front view of the present invention shown the canopy transitioning between being opened and being expanded.

With reference now to the drawings, and in particular to FIGS. 1 through 5 thereof, a new umbrella apparatus embodying the principles and concepts of the present invention and generally designated by the reference numeral 10 will be described. Certain aspects of the supporting structure of an umbrella are common, well known, and conventional, such as those aspects described in the patents mentioned above, including U.S. Pat. No. 4,077,421 and U.S. Pat. No. 3,802,452, and in the interest of brevity (and consistent with MPEP section 2164.01) will nor be repeated here.

As best illustrated in FIGS. 1 through 5, the umbrella apparatus 10 generally comprises a shank member 11 being designed for being gripped by a user.

A support assembly 12 is operationally coupled to the shank member 11. The support assembly 12 is selectively actuated between a deployed position and an expanded position whereby the support assembly 12 is designed for being actuated by the user.

A canopy member 13 is coupled to the support assembly 12. The canopy member 13 opens when the support assembly 12 is the deployed position whereby the canopy member 13 provides a first coverage area designed for sheltering the user from the rain. The canopy member 13 expands when the support assembly 12 is in the expanded positioned whereby the canopy member 13 provides a second coverage area greater than the first coverage area designed for sheltering a plurality of people from the rain.

The canopy member 13 comprises a pleat 14. The pleat 14 extends along a diameter of the canopy member 13 whereby the pleat 14 permits portions of the canopy member 13 to be folded when the canopy member 13 is opened by the support assembly 12 in the deployed positioned. The pleat 14 allows the canopy member 13 to be fully unfolded to provide the second coverage area when the canopy member 13 is expanded by the support assembly 12 in the expanded position.

The canopy member 13 comprises a water repellant material. The water repellant material is designed for repelling rain striking the canopy member 13 whereby the canopy member 13 provides coverage for the user positioned under the canopy member 13.

The support assembly 12 comprises a pair of separating assemblies 15 and a collar member 16. The collar member 16 is slidably coupled to the shank member 11 whereby the collar member 16 is slidable along the length of the shank portion. Each of the separating assemblies 15 is operationally coupled to the collar member 16 whereby the separating assemblies 15 are selectively actuated between the deployed position and the expanded position. The separating assemblies 15 are coupled to the canopy member 13 whereby the separating assemblies 15 are for actuating the canopy between being opened and being expanded when the separating assemblies 15 are actuated by the user.

Each of the separating assemblies 15 comprises an arm member 17. The arm member 17 is pivotally coupled to the collar member 16 whereby the arm member 17 of each of the separating assemblies 15 are pivoted away from each other when the separating assemblies 15 are positioned in the expanded position. The arm member 17 of each of the separating assemblies 15 is positioned parallel to the shank portion when the separating assemblies 15 are positioned in the deployed position. The arm member 17 of each of the separating assemblies 15 is designed for being actuated by the user when the user wishes to actuate the canopy member 13 between being opened and being expanded.

Each of the separating assemblies 15 comprises a plurality of rib assemblies 18. Each of the rib assemblies 18 is pivotally coupled to the arm member 17 of the associated one of the separating assemblies 15 opposite the collar member 16. Each of the rib assemblies 18 is selectively pivoted between a stored position and an extended position. The stored position is defined by the rib assemblies 18 being positioned substantially parallel to the arm member 17 of the associated one of the separating assemblies 15. The extended position is defined by each of the rib assemblies 18 extending outwardly from the arm member 17 of the associated one of the separating assemblies 15. Each of the rib assemblies 18 extends along a portion of a radius of the canopy member 13 whereby the rib assemblies 18 open the canopy member 13 when the rib assemblies 18 are positioned in the extended position. The rib assembly draws the canopy member 13 around the shank member 11 for facilitating storage when the rib assemblies 18 are positioned in the stored position. The rib assemblies 18 may be coupled to the arm member 17 of the associated one of the separating assemblies 15 (see FIG. 5) by a variety of means, such as, but not limited to, the use of a rivet positioned in a hole in the rib assemblies 18 which would allow the rib assemblies 18 to pivot laterally with respect to the arm members 17 (see, e.g., the rivet at the top end of the arm members 17 shown in FIG. 5).

A handle member 19 is coupled to the shank member 11. The handle member 19 is positioned opposite the canopy member 13. The handle member 19 is designed for being gripped by the user for facilitating positioning of the canopy member 13 over a head of the user to protect the head of the user from the rain.

Figure 3:
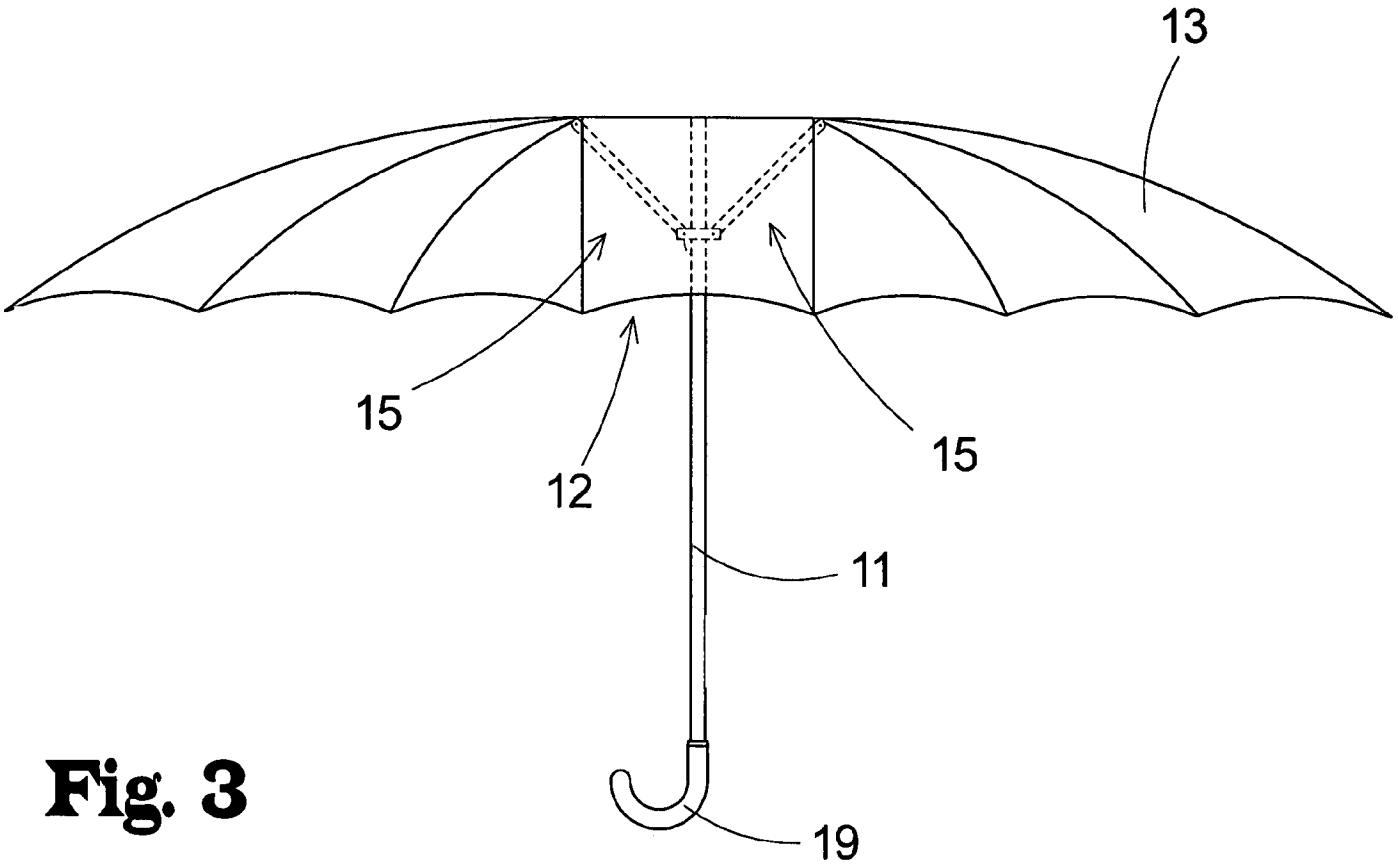
FIG. 3 is a front view of the present invention showing the support assembly in the expanded position.
Figure 4:
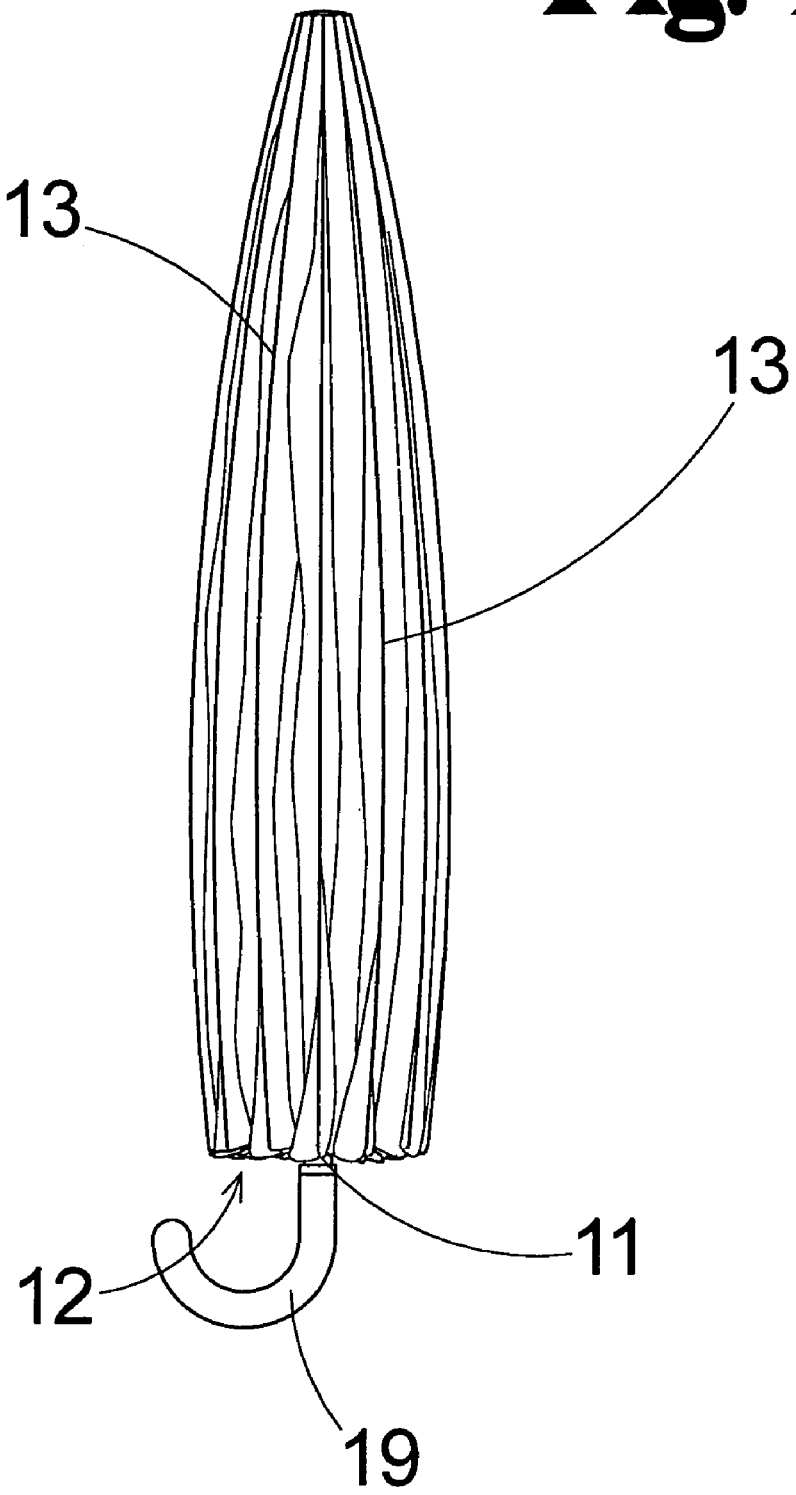
FIG. 4 is a front view of the present invention shown with the rib assemblies in the stored position.
Figure 5:
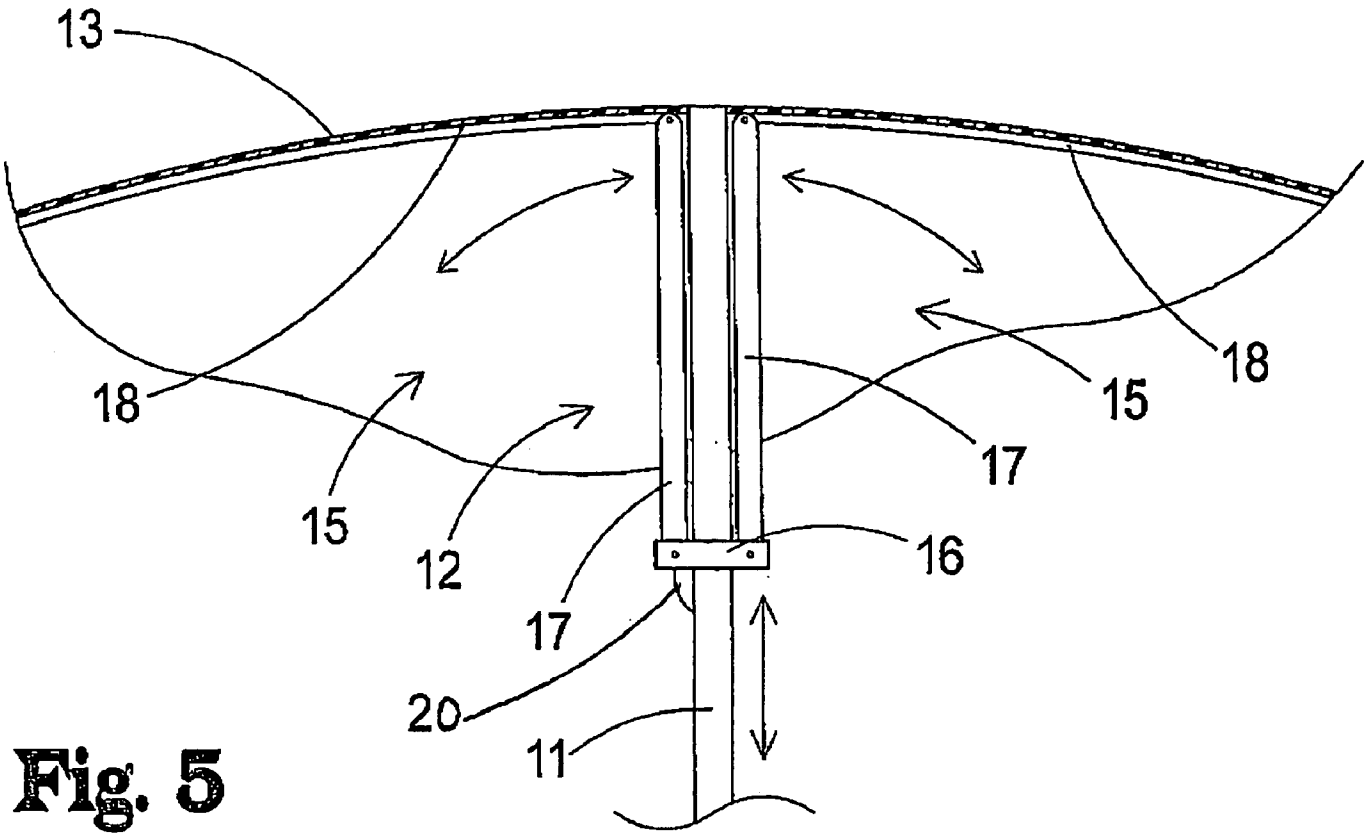
FIG. 5 is an enlarged front view of the support assembly of the present invention.

As shown in FIGS. 1, 3, and 5, at least one locking member 20 is operationally coupled to the shank member 11. The locking member 20 is biased outwardly from the shank member 11 whereby the locking member 20 is forced into the shank member 11 when the collar member 16 slides along the shank member 19 towards the canopy member 13. The locking member 20 extends outwardly from the shank member 11 and engages a bottom of the collar member 16 to inhibit inadvertent sliding of the collar member 16 along the shank member 11 away from the canopy member 13 to secure the canopy member 13 open. The locking member 20 is selectively depressed into the shank member 11 to disengage the locking member 20 from the collar member 16 and allow the collar member 16 to be slid along the shank member 11 away from the canopy member 13 to allow the canopy member 13 to be closed. It will be appreciated from the locking member 20 controls movement of the collar member 16, which controls the expansion of the canopy member 13 from the retracted position (see FIG. 1) to the expanded position (see FIG. 3) while the canopy is deployed or raised out of the storage position see FIG. 4).

In use, the user slides the collar member 16 along the shank member 11 towards the canopy member 13 to pivot the rib assemblies 18 into the extended position and open the canopy member 13. The user can then pivot the arm member 17 of each of the separating assemblies 15 away from each other to unfold the pleat 14 of the canopy member 13 and increase the area of coverage of the canopy member 13. The user then brings the arm member 17 of each of the separating assemblies 15 towards the shank member 11 and slides the collar member 16 towards the handle member 19 to pivot the rib assemblies 18 to the stored position and bring the canopy member 13 around the shank member 11 to facilitate storage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella apparatus for providing protection from rain for one or more people, the umbrella apparatus comprising:

a shank member being adapted for being gripped by a user;

a support assembly being operationally coupled to said shank member, said support assembly being selectively actuated between a deployed position and an expanded position such that said support assembly is adapted for being actuated by the user;

a canopy member being coupled to said support assembly, said canopy member opening when said support assembly is in said deployed position such that said canopy member provides a first coverage area adapted for sheltering the user from the rain, said canopy member expanding when said support assembly is in the expanded position such that said canopy member provides a second coverage area greater than the first coverage area adapted for sheltering a plurality of people from the rain;

said canopy member comprising a pleat, said pleat extending along at least a radius of said canopy member such that said pleat permits portions of said canopy member to remain folded when said canopy member is opened by said support assembly in said deployed position, said pleat allowing said canopy member to be fully unfolded to provide said second coverage area when said canopy member is expanded by said support assembly in said expanded position;

said canopy member comprising a water repellant material, said water repellant material being adapted for repelling rain striking said canopy member such that said canopy member provides coverage for the user positioned under said canopy member;

said support assembly comprising a pair of separating assemblies and a collar member, said collar member being slidably coupled to said shank member such that said collar member is slidable along the length of said shank member, each of said separating assemblies being operationally coupled to said collar member such that said separating assemblies are selectively actuated between said deployed position and said expanded position, said separating assemblies being coupled to said canopy member such that said separating assemblies are for actuating said canopy between being opened and being expanded when said separating assemblies are actuated by the user, said collar member being positioned proximate said canopy member such that said collar member and said separating assemblies are positioned to allow the maximum amount of coverage for people positioned under said canopy member;

each of said separating assemblies comprising an arm member, said arm member being pivotally coupled to said collar member such that said arm member of each of said separating assemblies are pivoted away from each other when said separating assemblies are positioned in said expanded position, said arm member of each of said separating assemblies being positioned parallel to said shank member when said separating assemblies are positioned in said deployed position, said arm member of each of said separating assemblies being adapted for being actuated by the user when the user wishes to actuate said canopy member between being opened and being expanded;

each of said separating assemblies comprising a plurality of rib assemblies, each of said rib assemblies being pivotally coupled to said arm member of the associated one of said separating assemblies opposite said collar member, each of said rib assemblies being selectively pivoted between a stored position and an extended position, said stored position being defined by said rib assemblies being positioned substantially parallel to said arm member of the associated one of said separating assemblies, said extended position being defined by each of said rib assemblies extending outwardly from said arm member of the associated one of said separating assemblies, each of said rib assemblies extending along a portion of a radius of said canopy member such that said rib assemblies open said canopy member when said rib assemblies are positioned in said extended position, said rib assembly drawing said canopy member around said shank member for facilitating storage when said rib assemblies are positioned in said stored position; and a handle member being coupled to said shank member, said handle member being positioned opposite said canopy member, said handle member being adapted for being gripped by the user for facilitating positioning of said canopy member over a head of the user to protect the head of the user from the rain.

* * * * *